United States Patent [19]

Cork

[11] 4,372,399

[45] Feb. 8, 1983

[54] DRILL BIT WITH WEDGE SHAPED EDUCTION JETS

[75] Inventor: Michael S. Cork, Mesquite, Tex.

[73] Assignee: Development Oil Tool Systems, Garland, Tex.

[21] Appl. No.: 357,066

[22] Filed: Mar. 11, 1982

[51] Int. Cl.[3] ..... E21B 10/60

[52] U.S. Cl. ..... 175/65; 175/339; 175/340; 175/422

[58] Field of Search ..... 175/65, 339, 340, 393, 175/400, 422, 213, 332, 329; 76/108 A; 239/601

[56] References Cited

U.S. PATENT DOCUMENTS

| | | | |
|---|---|---|---|
| 2,776,115 | 1/1957 | Williams | 255/313 |
| 3,111,179 | 11/1963 | Albers | 175/393 |
| 3,737,108 | 6/1973 | Stumphauzer et al. | 239/601 |
| 3,843,055 | 10/1974 | Nord et al. | 239/601 |
| 3,858,812 | 1/1975 | Williams et al. | 239/601 |
| 3,923,109 | 12/1975 | Williams | 175/340 |
| 4,022,285 | 5/1977 | Frank | 175/65 |
| 4,038,417 | 4/1978 | Arnold | 175/393 |
| 4,222,447 | 9/1980 | Cholet | 175/340 |
| 4,239,087 | 12/1980 | Castel et al. | 175/340 |
| 4,240,513 | 12/1980 | Castel et al. | 175/340 |

*Primary Examiner*—James A. Leppink
*Assistant Examiner*—William P. Neuder
*Attorney, Agent, or Firm*—Thomas L. Cantrell; Mark Andrew Smith; Joseph H. Schley

[57] ABSTRACT

Disclosed is a drill bit with an eduction jet which discharges drilling mud upwardly through nozzles having wedge shaped apertures oriented such that the wedge shape is tangential to the central axis about which the drill bit rotates. Expelled mud projects a wedge shaped dynamic stream of mud which retains the definition as an eductive column which rotates with the drill bit and therefore has relative motion revolving transverse to the hydrostatic column bearing upon the bit. Throughout the regions in which it retains definition, the eductive column creates a low pressure zone immediately behind it and the low pressure zone enhances the ability of flushing jets to remove cuttings from the bottom of the borehole by drawing the cuttings above the drill bit. The manufacture of drill bits with wedge shaped eduction jets is also disclosed, including the manufacture by modification of conventional tri-cone bits.

8 Claims, 3 Drawing Figures

DRILL BIT WITH WEDGE SHAPED EDUCTION JETS

BACKGROUND OF THE INVENTION

The present invention relates to an improved drill bit for oil and gas well applications. Typically, conventional drill bits employ a plurality of depending cones and each cone carries a great number of cutting surfaces thereon. These cones are rotatably attached to the drill bit body upon axels radially arranged about the central axis of the drill bit and are disposed to engage the bottom of the borehole.

In operation, rotation is imparted to the drill string which extends from the surface down the borehole to the drill bit. The body of the drill bit is thereby rotated and the cones which press against the bottom of the borehole spin about their axes, usually about sealed bearings, as the bit body is rotated. The cutting surfaces of these spinning cones free bits of the rock formation as they roll across the floor of the borehole.

The problem addressed by the present invention is the removal of the cuttings from the base of the borehole once they have been freed from the formation. If these cuttings are not effectively removed, the cutting surfaces upon the cones operate only to further pulverize previous cuttings and are prevented from effectively biting into the formation as necessary to advance the drilling.

It is conventional to pump a stream of mud through the drill string, through the bores and conduits in the main body of the drill bit, and to expell this mud downwardly from the body of the drill bit at the cones. The mud delivered through the drill bit performs several functions in that it cools the bit, stabilizes the borehole, holds the drill bit and drill string within the borehole by equalizing the pressure on the bit and, most important to the present invention, the current of mud is intended to sweep away the cuttings at the cones.

The present invention addresses the efficiency of flushing the cuttings away and also addresses two problems attendant the prior art solution, the problems of well bore and drill string erosion. Drill string erosion is introduced by the use of the mud flow and refers to the abnormally high rate of wear at the drill string adjacent the drill bit caused by the abrasion of particles and cuttings within the flow of mud. A similar problem is erosion of the borehole itself caused by the flow of mud and abrasive particles returning up the borehole about the drill bit.

SUMMARY OF THE INVENTION

The present invention improves upon the conventional mud flow by using up or eduction jets which are of a specific configuration to maximize the lift of the cuttings into the hydrostatic column of mud. As in conventional drill bits, mud is pumped down the drill string to a bore within the body of the bit. There the bore branches forming conduits which provide at least one downwardly oriented down or flushing jet, as have been conventionally applied, but, in the present invention other branches of the bore form upwardly oriented eduction jets. The mud conduits within the main bit body which feed the eduction jets are turned upwardly toward nozzels that regulate the shape and orientation of the mud stream expelled through the eduction jets. The flow of mud is expelled through wedge shaped apertures defined by the nozzels. Further, the apertures are oriented such that the wedge shape is tangential to the central axis about which the drill bit rotates and the narrower edge of the wedge is positioned to be the leading edge when rotation is imparted to the drill bit body.

Expelling mud through these nozzels projects a wedge shaped eductive column of mud flowing into the hydrostatic column bearing upon the bit. Further, the eductive column of mud retains the wedge shape of the nozzels through which it is discharged for a substantial distance into the hydrostatic column. The eductive column is dicharged from the eduction jet which is rotating with the drill bit and therefore the eductive column has a relative motion revolving transverse to the hydrostatic column. Throughout the regions in which it retains definition, the eductive column affects the hydrostatic column in much the same way as a solid object of the same configuration would as it moved through the hydrostatic column. The result is the creation of a low pressure zone which follows behind the revolving eductive column. This low pressure zone enhances the ability of the conventional downwardly oriented flushing jets to remove cuttings from the bottom of the bore hole because the lift of the low pressure zone in the hydrostatic columns draws the cuttings above the drill bit and the improved removal of cuttings increases the penetration or rate at which the drilling advances through the formation. Further, the enhanced flow also cools the bit which increases bearing life in the drill bit. Thus a drill bit constructed in accordance with the present invention both increases the rate of drilling and lengthens the periods between costly procedures of shutting down drilling operations and pulling the drill string to allow replacement or overhaul of the drill bit.

A drill bit in accordance with the present invention is conveniently constructed by modifying a conventional tri-cone bit. The preferred modification is to plug two of the three downwardly oriented conventional flushing jets and apertures are tapped above each conduit leading into plugged jets. Upwardly directed conduits are mounted into the tapped apertures and the wedge shaped nozzels are mounted and properly oreinted in the terminal ends of these upwardly directed conduits.

Alternatively, mud conduits within the main bit body are formed into downwardly oriented flushing jets and upwardly oriented eduction jets when the main bit body is originally formed.

A BRIEF DESCRIPTION OF THE DRAWINGS

A DETAILED DESCRIPTION OF THE DRAWINGS

The preferred embodiment of the present invention is constructed by modification of an existing, conventional drill bit and the modification is emphasized in the disclosure below. However, the scope of invention does, of course, include drill bits formed at initial manufacture in accordance with the present invention.

Figure 1:
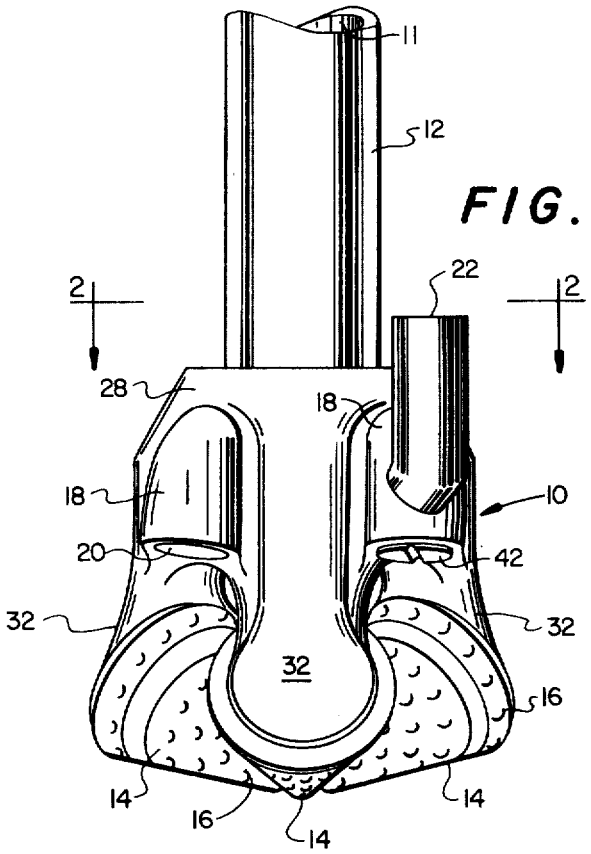
FIG. 1 is a side-elevational plane view of a drill bit constructed in accordance with the present invention.
Figure 2:
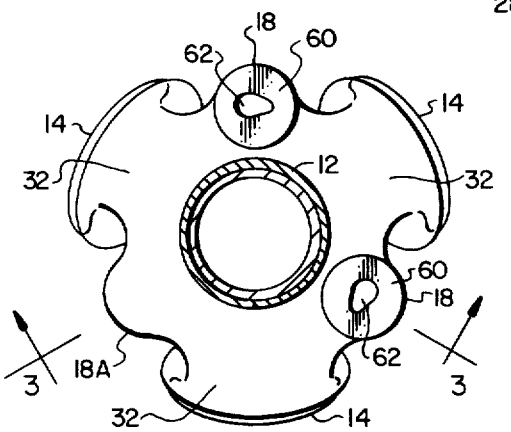
FIG. 2 is a cross-section of a drill bit of the present invention taken along line 2—2 of FIG. 1.
Figure 3:
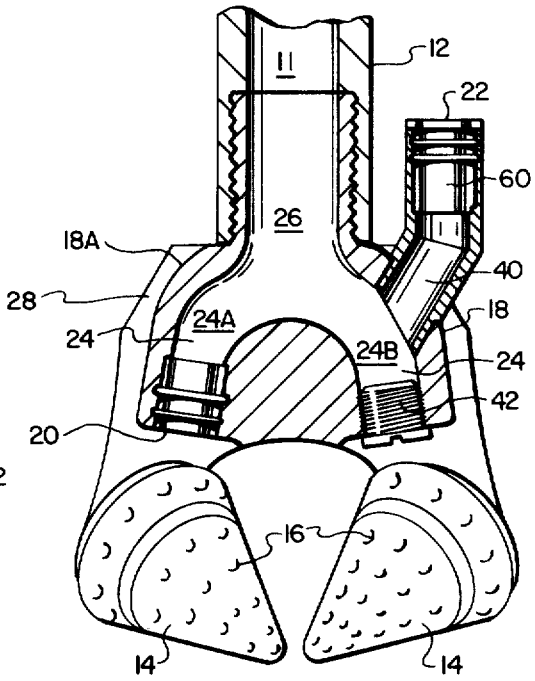
FIG. 3 is a longitudinal cross-sectional view taken along line 3—3 of FIG. 2 of a drill bit constructed in accordance with the present invention.

The structure of the present invention is illustrated in FIGS. 1, 2 and 3.

FIG. 1 is a side-elevational view of the present invention which is designated generally as drill bit 10. Drill bit 10 is connected to the terminal end of drill string 12. FIG. 2 is a horizontal cross section through the drill string and looking down on the top side of drill bit 10 and, in particular, showing wedge shaped aperture 62 through nozzle 60. The vertical cross section through the drill string and drill bit illustrated in FIG. 3 shows two of conduits 24, conduits 24A and 24B. Note that the cutting plane of line 3—3 has been manipulated in order to best illustrate cross sections of both conduits 24A and 24B within a single figure.

Referring to FIGS. 1 and 3, drill bit 10 is shown to have two types of lobes, cone mounting lobes 32 and shoulders 18 which are set between the cone mounting lobes. Cones 14 are mounted to cone mounting lobes 32 in a manner that allows rotation of the cones upon the cone mounting lobes. Buttons 16 or other suitable cutting means such as teeth or studs are mounted on the periphery of cones 14 to provide cutting surfaces for digging through formations. Drill string 12 has a hollow mud conducting bore 11 connectable in fluid communication with bore 26 through main bit body 28. Bore 26 branches to form mud conduits 24 designated conduits 24A and 24B in FIG. 3. Shoulders 18 are protrusions of main bit body 28 under which conduits 24 run. In the illustrated embodiment, drill bit 10 was originally provided with three down jets, each emanating from a mud conduit 24 under a shoulder 18. Modification of a conventional drill bit to a drill bit of the present invention is illustrated by the combination of FIGS. 1 and 3. Here conduit 24B is tapped through shoulder 18 and eduction conduit 40 is placed in fluid connection therewith. The end of modified conduit 24B through which a flushing jet would have otherwise discharged in the conventional system is closed with the plug 42. Plug 42 is configured to sealingly engage the sides of conduit 24B to securely seal the end of that conduit. Conventional sealing means such as threaded engagement, welding, or sealing with O-rings are appropriate to secure plug 42 into conduit 24B.

In the preferred embodiment, two flushing jets are modified to become eduction jets 22 by the addition of conduits 40 and plugs 42 and one flushing jet is retained. In FIG. 2, conduit 24A under shoulder 18A is retained as a flushing jet 20 and shoulders 18B and 18C have been tapped for eduction jets 22. Eduction jets 22 terminate in nozzle 60 which have a wedge-shaped aperture therethrough designated aperture 62. In modified tricone bits it has been found effective to size apertures 62 to approximate the cross-sectional area of the discharge hole that existed in the flushing jets prior to pluging them for conversion to eduction jets. Further, it is preferred that the corners of the wedge shaped apertures be somewhat rounded.

It is clear that this conduit pathway is establishable upon manufacture of a new drill bit rather than modifying a conventional bit as discussed above.

Figure 4:
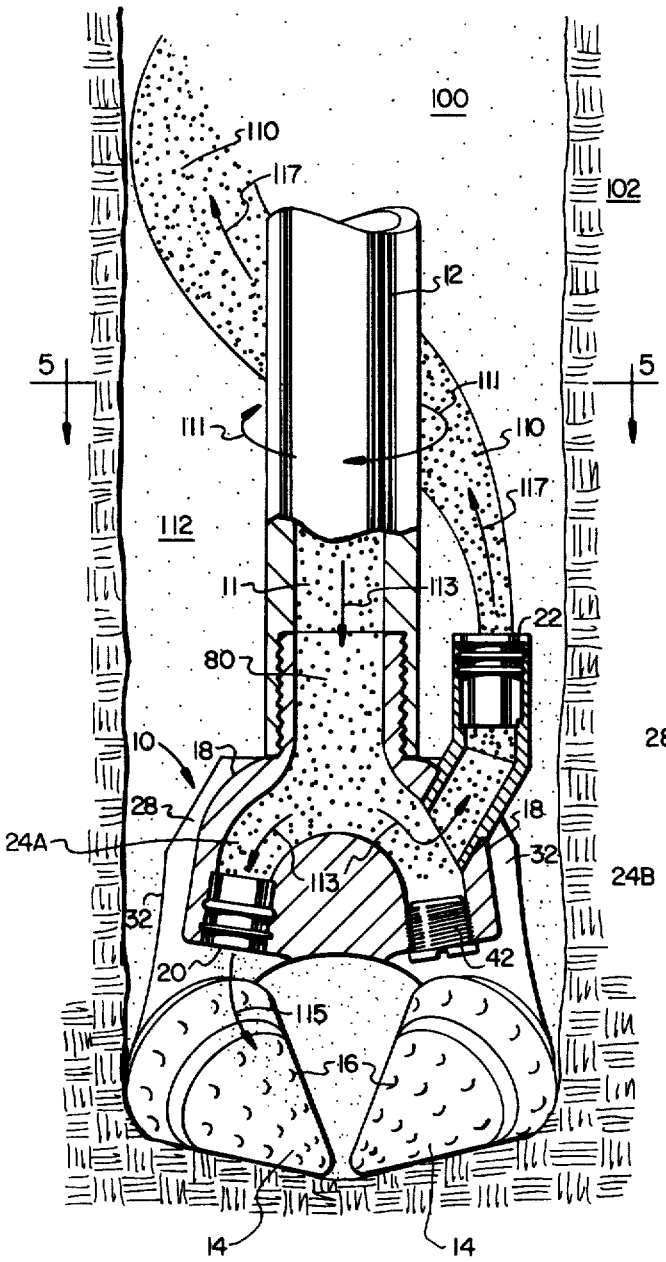
FIG. 4 is a partially sectional side view of a drill bit constructed in accordance with the present invention operating in a bore hole.
Figure 5:
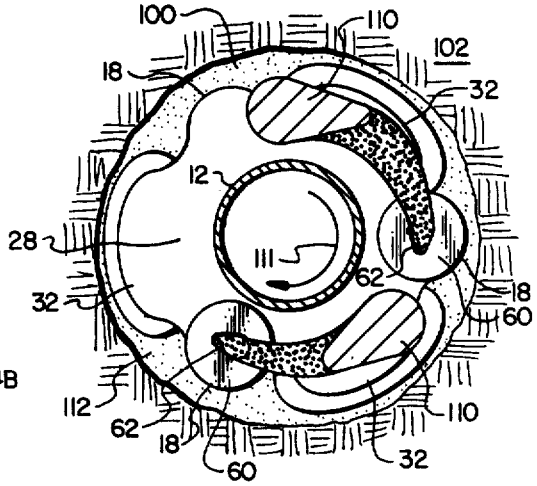
FIG. 5 is a cross-sectional view taken along line 5—5 of FIG. 4 of the present invention.

FIGS. 4 and 5 best illustrate the operation of the present invention and include a schematic representation of flowing mud 80. FIG. 4 is a partially sectioned side view of drill bit 10 depending on drill string 12 within bore hole 100 through formation 102 and FIG. 5 is a cross-section of FIG. 4. Mud 80 expelled through eduction jet 22 establishes an initially well defined dynamic stream, eductive column 110, through the relatively static mud of hydrostatic column 112 in the area closely above drill bit 10.

The motion of mud and machinery has been indicated with designated arrows. Arrows 111 illustrate the rotation imparted to drill string 12 and therethrough to drill bit 10. Arrows 113 illustrate the flow of mud 80 down the center of drill string 12, through bore 26, and through conduits 24A and 24B to be ultimately expelled through flushing jet 20 and eduction jet 22, respectively. The flow of mud exiting main bit body 28 through flushing jet 20 and eduction jet 22 is illustrated by arrows 115 and 117, respectively.

The mud expelled through flushing jet 20 picks up cuttings at the bottom of bore hole 100 and suspends them as flushing jets do in conventional drilling. However, the present invention greatly increases the efficiency of carrying the cuttings over lobes 32 and shoulders 14 and away from the bottom of the bore hole by establishing a low pressure zone to draw this mud and suspended cuttings away from the cutting regions of bore hole 100.

The mud discharged from eduction jet 22 maintains substantial definition in the relatively static mud in the hole and the eductive column 110 thus projects a spiral up the bore hole about drill string 10 as the origin of the eductive column, eduction jet 22, rotates with the body of the bit. Nearest the drill bit, this column maintains its identity sufficiently to affect the relatively static hydrostatic column 112 through which the eductive column 110 is moved. FIG. 5 illustrates in cross section the wedge shaped eductive column at a region through which the eductive column maintains definition. The eductive column moves crosswise relative to the relatively static mud in the hole and creates an effect similar to a solid object being rotated with the drill bit. The relative movement of eductive column 110 within hydrostatic column 112 causes the hydrostatic mud to flow about the eductive column with an effect substantially analogous to an air foil through static air, thereby establishing a low pressure zone immediately following the column.

Another benefit of the wedge shape of the eductive column 110 is that penetration into the hydrostatic column is thereby maximized with minimal lateral spread such as would bring a flow of relatively dynamic drilling mud into contact with both the wall of the well bore 100 and the exterior of the drill string 12. Further, the drawing effect of the low pressure zone in the hydrostatic column 112 behind eductive column 110 provides for a more orderly extraction of cuttings above main bit body 28 and away from the operating cutting surfaces on cone 14. Allowing the cuttings to be drawn rather than solely pushed by drilling mud and the control of the eductive column causing this effect substantially reduces both drill string errosion and errosion of the bore hole itself.

A futher benefit of the present invention is the improved cooling effectiveness of the mud flowing through the drill bit. Bearing failure is a primary cause of drill bit failure and more effective cooling of the drill bit helps prevent lubrication failure in the bearings at the rotatable connection of cones 14 to cone mounting lobes 32.

Each of the attributes outlined above interact to greatly improve drilling efficiency.

A drill bit initially manufactured in accordance with the present invention establishes multiple mud conduits 24 for ultimate mud flow communication with bore 11 of drill string 12. It is preferred that this mud flow pass from bore 11 of the drill string to bore 26 of the main drill bit body and through bore 26 to mud conduits 24 established as branches of bore 26. The main bit body is formed with means for mounting cones such as cones mounting lobes 32 and the upper extremity of main drill bit body 28 is formed to receive drill string 12 in a manner that rotatably fixes drill string 12 to the main bit body in accordance with mud flow communication discussed above. One or more cones 14 having cutting means such as buttons 16 disposed on their periphery are rotatably connected beneath the main bit body. Mud conduits 24 terminate in either downwardly oriented flushing jets 20 or upwardly oriented eduction jets 22. It is through both of these jets that drilling mud leaves the drilling apparatus and is expelled into the downhole environment, within well bore 100. Nozzles 60 are mounted at the exiting terminus of mud conduits 24B which are upwardly turned to feed eduction jets 22. Nozzles 60 define wedge shaped apertures therethrough, apertures 62, which are oriented tangential to the axis of rotation of the drill bit in such that the narrower edge of the wedge leads in rotation.

Having described the invention in connection with certain specific embodiments thereof it is to be understood that further modifications may now suggest themselves to those skilled in the art, and it is intended to cover such modification as followed in the scope of the appended claims.

I claim:

1. In combination with a drill bit for connection to a torque and mud transmitting drill string, said drill bit being of the type having a main bit body with a mud conduit therethrough connectable to receive mud transmitted through the drill string; cutting means mounted on said main bit body; and at least one flushing jet through which said mud is expellable downwardly from said main bit body; the improvement comprising:

an eduction jet through which said mud received from said drill string is expellable upwardly from said main bit body; and a nozzle at the explusion end of said eduction jet, said nozzle defining a substantially wedge shaped aperture through which said mud is expelled, said substantially wedge shaped aperture having an orientation which is tangential to the rotation of said drill bit and in which the narrower end of the substantially wedge shaped aperture leads in the rotation of the drill bit.

2. In a drill bit for connection to a torque and mud transmitting drill string, said drill bit being of the type having a main bit body with a mud conduit therethrough connectable to receive mud transmitted through the drill string;

a plurality of cone mounting lobes projecting downwardly from said main bit body; a cone rotatably mounted on each said cone mounting lobe, cutting surfaces fixed to the periphery of each said cone; and at least one flushing jet through which mud is expellable downwardly from said main bit body, each said flushing jet being in mud flow communication with said mud conduit in said main bit body; the improvement comprising:

at least one eduction jet through which said mud is expellable upwardly from said main bit body, each said eduction jet being in mud flow communication with said mud conduit of said main bit body and discharging at an expulsion end exteriorly adjacent said drill string; and a nozzle at the expulsion end of said eduction jet, said nozzle defining a wedge shaped aperture disposed to expell a wedge shaped eductive column of mud, said wedge shaped aperture having an orientation which is tangential to the rotation of said bit and in which the narrower end of the wedge shaped aperture leads upon the rotation of the drill bit;

whereby an eductive column is discharged from the eduction jet which rotates with the drill bit, thereby creating an eductive column which has relative movement transverse to the hydrostatic column which creates a low pressure zone that follows the eductive column within the hydrostatic column as the eductive column circularly sweeps through the hydrostatic column.

3. A drill bit constructed in accordance with claim 2 in which said drill bit is of the tri-cone type having one said flushing jet and two said eduction jets.

4. A drill bit constructed in accordance with claim 2 in which said drill bit is of the bi-cone type having one said flushing jet and one said eduction jet.

5. A drill bit constructed in accordance with claim 2 in which said drill bit is of the four-cone type having one said flushing jet and three said eduction jets.

6. A method of modifying a tri-cone bit of the type having a main bit body with a mud conduit therethrough connectable to receive mud transmitted from a drill string, three cone mounting lobes projecting downwardly from said main bit body, a cone having cutting edges rotatably mounted on each said cone mounting lobe, and flushing jets set between each pair of adjacent cones; the method of modification comprising:

plugging two of said flushing jets to prevent mud flow therethrough, thereby establishing plugged flushing jets;

tapping aperatures from the top of said main bit body into the mud conduits leading to said plugged flushing jets;

mounting a first end of eduction conduits through said tapped apertures into fluid communication with said mud conduit of said main bit body; and and mounting nozzles having wedge shaped apertures therethrough into a second end of said eduction conduits, orienting said nozzles to present the narrow edge of said wedge shaped aperture to lead in rotation with said drill bit;

whereby a conventional tri-cone bit is modified to present one said flushing jet and two said eduction jets, said eduction jets being expelled through said wedge shaped apertures which rotate with the drill bit, thereby producing wedge shaped eductive columns in the relatively hydrostatic column of mud impinging on the top of the drill bit.

7. A method of manufacturing a drill bit of the type having a main bit body with a mud conduit therethrough connectable to receive mud transmitted from a drill string, said method of manufacture comprising:

establishing at least one flushing jet in mud flow communication with said mud conduit, said flushing jet being disposed to discharge said mud downwardly from said main bit body;

establishing at least one eduction jet in mud flow communication with said mud conduit, said eduction jet being disposed to discharge said mud upwardly from said main bit body; and mounting nozzles having wedge shaped apertures therethrough into the upper end of said eduction conduit, orienting said nozzles to present the narrow edge of said wedge shaped aperture to lead in rotation with said drill bit.

8. A method of drilling a well bore using a drill bit of the type having a main bit body with at least first and second mud conduits therethrough connectable to transmit mud and torque through a drill string and cutting means mounted on said main bit body, said method of drilling comprising:

imparting rotation through the drill string to the drill bit;

freeing cuttings from the bottom of the well bore with said cutting means;

pumping a main flow of mud down the drill string;

dividing the main flow of mud received from said drill string into first and second flows of mud within respective first and second mud conduits;

expelling the first flow of mud downwardly from the first said mud conduit in a flushing jet;

expelling the second flow of mud upwardly from the second said mud conduit in an eduction jet;

controlling the second flow of mud in the eduction jet by expulsion through a wedge shaped aperture defined by a nozzle, said wedge shaped aperture having an orientation which is tangential to the rotation of said drill bit and in which the narrower end of the wedge shaped aperture leads upon the rotation of the drill bit; said eduction jet establishing a dynamic eductive column as it is expelled from the drill bit; and revolving said eductive column relative to a hydrostatic column of said mud impenging upon said drill bit by the rotation of the drill bit, thereby creating a low pressure zone above the drill bit in said hydrostatic column posterior to the revolving eductive column;

whereby the removal of the cuttings from the bottom of the bore hole is enhanced as the cuttings are drawn to the low pressure zone above the drill bit.

* * * * *